US008665171B2

(12) United States Patent
Maruyama

(10) Patent No.: US 8,665,171 B2
(45) Date of Patent: Mar. 4, 2014

(54) DIVERSITY ANTENNA APPARATUS INCLUDING RECTIFIER DEVICE

(75) Inventor: Kimihiro Maruyama, Tokyo (JP)

(73) Assignee: Fujitsu Component Limited, Tokyo (JP)

( * ) Notice: Subject to any disclaimer, the term of this patent is extended or adjusted under 35 U.S.C. 154(b) by 214 days.

(21) Appl. No.: 13/298,585

(22) Filed: Nov. 17, 2011

(65) Prior Publication Data

US 2012/0133570 A1 May 31, 2012

(30) Foreign Application Priority Data

Nov. 30, 2010 (JP) ..... 2010-267446

(51) Int. Cl.
*H01Q 21/00* (2006.01)

(52) U.S. Cl.
USPC ..... 343/853; 343/876; 343/893; 343/745

(58) Field of Classification Search
USPC ..... 343/745, 853, 876, 893
See application file for complete search history.

(56) References Cited

U.S. PATENT DOCUMENTS

| | | | | |
|---|---|---|---|---|
| 6,108,526 | A | 8/2000 | van der Plas | |
| 2005/0200538 | A1 * | 9/2005 | Tran | 343/702 |
| 2008/0305750 | A1 * | 12/2008 | Alon et al. | 455/77 |
| 2009/0267842 | A1 * | 10/2009 | Takagi et al. | 343/702 |

FOREIGN PATENT DOCUMENTS

JP 11-008576 1/1999

* cited by examiner

*Primary Examiner* — Dieu H Duong
(74) *Attorney, Agent, or Firm* — IPUSA, PLLC

(57) ABSTRACT

A diversity antenna apparatus includes a feed line through which radio communication power is transmitted, antennas connected in cascade through the feed line, and a first rectifier device placed in the feed line, wherein a first one of the antennas and a second one of the antennas each include a second rectifier device having an input terminal thereof connected to the feed line, an antenna device connected to an output of the first rectifier device, and a third rectifier device having an input terminal thereof connected to a connection point between the second rectifier device and the antenna device, and having an output terminal thereof grounded, wherein the first rectifier device placed in the feed line connects between the input terminal of the second rectifier device of the first one of the antennas and the input terminal of the second rectifier device of the second one of the antennas.

5 Claims, 3 Drawing Sheets

DIVERSITY ANTENNA APPARATUS INCLUDING RECTIFIER DEVICE

BACKGROUND OF THE INVENTION

1. Field of the Invention

The disclosures herein relate to a diversity antenna apparatus.

2. Description of the Related Art

Conventionally, a diversity-type antenna apparatus including a control circuit for switching antennas have been known (see Japanese Patent Application Publication No. H11-8576, for example).

In the case of a wireless-communication apparatus being a small-size terminal device, there are problems attributable to the smallness of the terminal. Such problems include a limitation to the number of antennas, the placement of coaxial cables connected to respective antennas, and the placement of control signal lines, etc.

Because of these problems, it may not be desirable to add a control circuit to a small-size terminal device for the purpose of switching antennas as has been done in the conventional art.

Accordingly, it may be desirable to provide a diversity antenna apparatus that has a simplified antenna switching circuit and can thus be applicable to a small-size communication terminal device.

SUMMARY OF THE INVENTION

It is a general object of the present invention to provide a diversity antenna apparatus that may substantially obviate one or more problems caused by the limitations and disadvantages of the related art.

According to an embodiment, a diversity antenna apparatus includes a feed line through which radio communication power is transmitted, antennas connected in cascade through the feed line, and a first rectifier device placed in the feed line, wherein a first one of the antennas and a second one of the antennas each include a second rectifier device having an input terminal thereof connected to the feed line, an antenna device connected to an output of the first rectifier device, and a third rectifier device having an input terminal thereof connected to a connection point between the second rectifier device and the antenna device, and having an output terminal thereof grounded, wherein the first rectifier device placed in the feed line connects between the input terminal of the second rectifier device of the first one of the antennas and the input terminal of the second rectifier device of the second one of the antennas.

According to at least one embodiment, a diversity antenna apparatus that has a simplified antenna switching circuit and can thus be applicable to a small-size communication terminal device is provided.

BRIEF DESCRIPTION OF THE DRAWINGS

Other objects and further features of the present invention will be apparent from the following detailed description when read in conjunction with the accompanying drawings, in which.

DESCRIPTION OF THE PREFERRED EMBODIMENTS

In the following, embodiments to which a diversity antenna apparatus of the present invention is applied will be described.

[First Embodiment]

Figure 1:
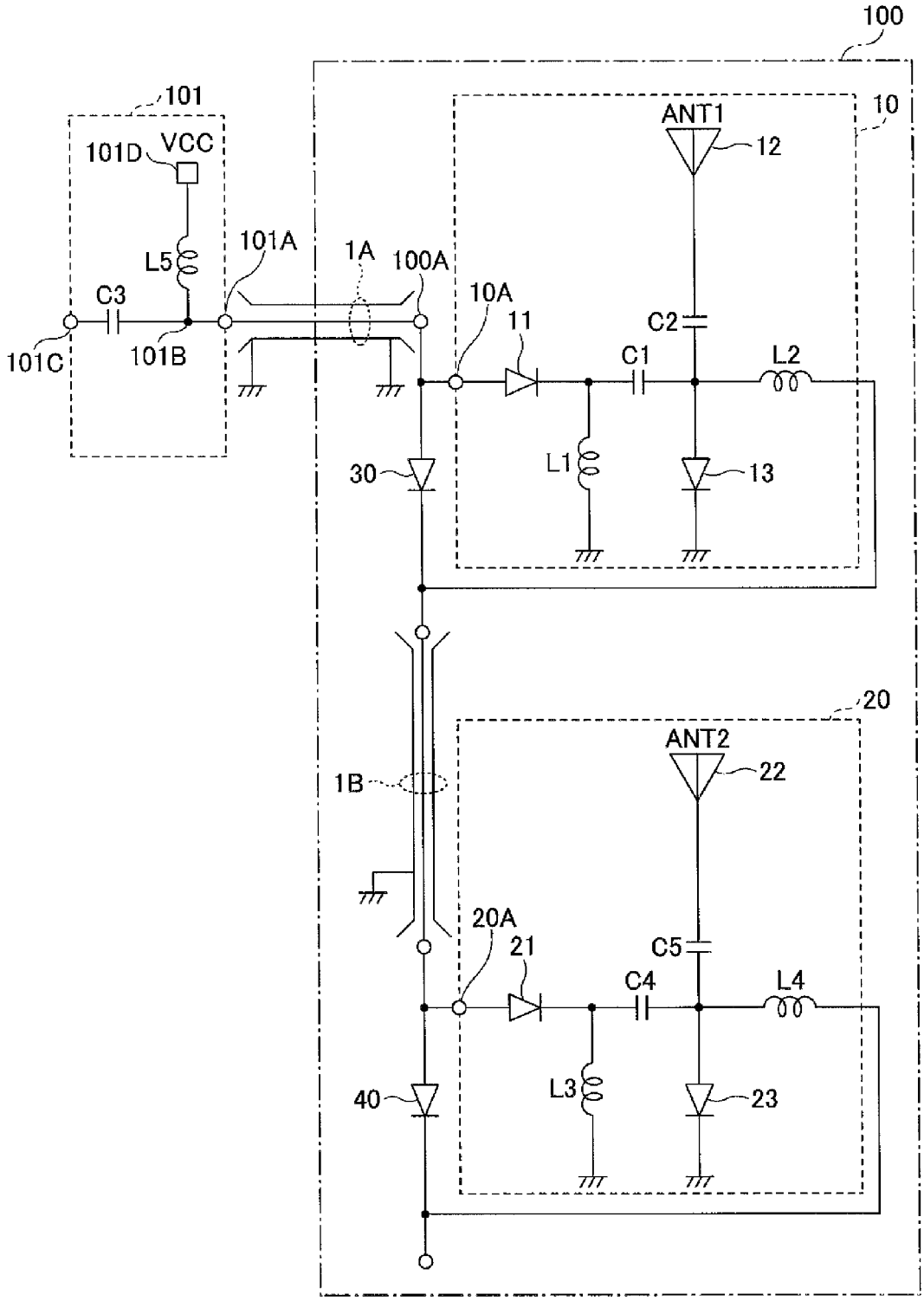
FIG. 1 is a drawing illustrating a circuit configuration of a diversity antenna apparatus according to a first embodiment.

FIG. 1 is a drawing illustrating a circuit configuration of a diversity antenna apparatus according to a first embodiment.

A diversity antenna apparatus 100 of the first embodiment is connected to a wireless communication apparatus 101 via a feed line 1A.

The diversity antenna apparatus 100 includes an antenna 10 and an antenna 20, which are connected in cascade via a feed line 1B.

Further, the diversity antenna apparatus 100 includes a rectifier device 30 connecting between the feed line 1A and the feed line 1B, and includes a rectifier device 40 connected to the downstream side of the feed line 1B.

The feed line 1A and the feed line 1B may typically be coaxial cables. The cable core of the feed line 1A has one end thereof connected to a power output terminal 101A of the wireless communication apparatus 101, and has the other end thereof connected to a feed node 100A of the diversity antenna apparatus 100.

The feed node 100A of the diversity antenna apparatus 100 is connected to an input terminal 10A of the antenna 10 and to an input terminal of the rectifier device 30. The shielding line of the feed line 1A is connected to the ground.

The cable core of the feed line 1B has one end thereof connected to an output terminal of the rectifier device 30, and has the other end thereof connected to an input terminal 20A of the antenna 20 and an input terminal of the rectifier device 40. The shielding line of the feed line 1B is connected to the ground.

The output terminal of the rectifier device 40 may be connected to an additional antenna, thereby increasing the number of antenna stages. The output terminal of the rectifier device 40 may not be connected to another output terminal. In such a case, a condenser for impedance adjustment may be connected to the output terminal of the rectifier device 40.

The antenna 10 includes a rectifier device 11 connected to the input terminal 10A, and further includes an antenna device 12 and a rectifier device 13, which are connected to the output of the rectifier device 11. The rectifier device 13 has the input terminal thereof connected to a connection point between the output terminal of the rectifier device 11 and the antenna device 12, with the output terminal thereof connected to the ground.

The antenna 10 further includes a coil L1, a coil L2, a condenser C1, and a condenser C2 in addition to the rectifier device 11, the antenna device 12, and the rectifier device 13.

The antenna 20 includes a rectifier device 21 connected to the input terminal 20A, and further includes an antenna device 22 and a rectifier device 23, which are connected to the output of the rectifier device 21. The rectifier device 23 has the input terminal thereof connected to a connection point between the output terminal of the rectifier device 21 and the antenna device 22, with the output terminal thereof connected to the ground.

The antenna 20 further includes a coil L3, a coil L4, a condenser C4, and a condenser C5 in addition to the rectifier device 21, the antennal device 22, and the rectifier device 23.

In the diversity antenna apparatus 100 of the first embodiment, the rectifier devices 11, 13, 21, 23, 30 and 40 are PIN diodes, and all have the same forward voltage Vf.

The wireless communication apparatus 101 includes a condenser C3 and a coil L5, both of which are connected to a connection point 101B that is connected to the power output terminal 101A. The wireless communication apparatus 101 further includes a variable direct-current voltage source 101D.

The condenser C3 connects between the connection point 101B and a radio-power input terminal 101C. The coil L5 connects between the connection point 101B and the variable direct-current voltage source 101D.

The variable direct-current voltage source 101D can control a direct-current power supply voltage (VCC) output therefrom. As the variable direct-current voltage source 101D, a digital potentiometer may be connected to a direct-current power supply, and the output terminal of this digital potentiometer may be connected to a current amplifying device such as an operational amplifier, thereby constituting a voltage source.

In the diversity antenna apparatus 100 of the first embodiment, when performing communication by use of the antenna 10, the variable direct-current voltage source 101D outputs a voltage that is higher than or equal to the forward voltage Vf of the rectifier devices 11, 13, 21, 23, 30, and 40 and lower than 2 Vf.

In the case of the forward voltage Vf being 0.7 V, for example, 2 Vf is equal to 1.4 V.

In the diversity antenna apparatus 100 of the first embodiment, when performing communication by use of the antenna 10, the output voltage of the variable direct-current voltage source 101D may be set to 1.0 V.

Upon the output voltage of the variable direct-current voltage source 101D being set to 1.0 V, the rectifier device 11 in the antenna 10 is turned on. Since the voltage drop across the rectifier device 11 is equal to Vf (=0.7 V) that is equal to the forward voltage of the rectifier device 11, the potential at the output node of the rectifier device 11 is 0.3 V. In this case, therefore, the rectifier device 13 is turned off.

Upon the output voltage of the variable direct-current voltage source 101D being set to 1.0 V, further, rectifier device 30 is also turned on. Since the potential at the output of the rectifier device 30 is 0.3 V, however, the rectifier device 21 in the antenna 20 is turned off.

As described above, setting the output voltage of the variable direct-current voltage source 101D to a first voltage that is 1.0 V results in the state in which radio power is transmittable between the radio-power input terminal 101C and the antenna device 12.

Upon the output voltage of the variable direct-current voltage source 101D being set to a second voltage that is 1.8 V, the potential at the output of the rectifier device 11 in the antenna 10 becomes equal to 1.1 V, which is the second voltage 1.8 V minus the forward voltage Vf (=0.7 V) of the rectifier device 11. The rectifier device 13 is thus turned on, thereby grounding the antenna device 12. Accordingly, communication is not performable through the antenna device 12.

Further, upon the output voltage of the variable direct-current voltage source 101D being set to the second voltage that is 1.8 V, the rectifier device 30 stays turned on, so that the potential at the output of the rectifier device 30 is set to 1.1 V.

Consequently, the rectifier device 21 in the antenna 20 is turned on, resulting in a state in which radio power is transmittable between the radio-power input terminal 101C and the antenna device 22.

Further, the potential at the output of the rectifier device 21 becomes equal to 0.4 V, which is 1.1 V minus the forward voltage Vf (=0.7 V) of the rectifier device 21. As a result, the rectifier device 23 in the antenna 20 stays turned off because its input voltage does not reach the forward voltage Vf (=0.7 V).

As described above, setting the output voltage of the variable direct-current voltage source 101D to the second voltage that is 1.8 V results in the state in which radio power is transmittable between the radio-power input terminal 101C and the antenna device 22.

In this manner, the diversity antenna apparatus 100 of the first embodiment allows either one of the antenna 10 and the antenna 20 to be selected for communication in response to the control of the output voltage of the variable direct-current voltage source 101D.

A third antenna having the same circuit configuration as the antennas 10 and 20 may be added on the downstream side of the rectifier device 40. In such a case, setting the output voltage of the variable direct-current voltage source 101D to a third voltage that is 2.5 V causes the antenna devices 12 and 22 to be turned off in the antennas 10 and 20, respectively, and achieves a state in which radio power is transmittable between the radio-power input terminal 101D and the antenna device included in the third antenna.

Even if the number of antenna stages is further increased, a proper setting to the output voltage of the variable direct-current voltage source 101D by taking into account the forward voltage Vf of the rectifier device makes it possible to switch antennas successively in a similar manner.

According to the first embodiment described above, the diversity antenna apparatus 100 that can switch antennas through the feed line (which collectively refers to the feed line 1A and the feed line 1B) is provided, without requiring a complex control circuit for switching antennas or dedicated signal lines for switching purposes.

Since there is no need for a control circuit or dedicated signal lines for switching purposes, this diversity antenna apparatus is suitable to be implemented in a small-size wireless communication terminal device.

Further, since a diversity system can be easily and readily implemented, satisfactory communication conditions can be provided by suppressing radio interference relating to the position and orientation of the small-size wireless communication terminal device.

The above description has been provided with reference to a configuration in which the rectifier devices 11, 13, 21, 23, 30, and 40 are PIN diodes. Use of Schottky diodes that have a smaller forward voltage Vf reduces the step size of the voltage that is output from the variable direct-current voltage source 101D for the purpose of switching antennas. This arrangement makes it possible to use a larger number of antennas connected in cascade.

Arrangement may be made such that the antenna device 12 and the antenna device 22 have different peak frequencies at which gain becomes the maximum. This arrangement provides the diversity antenna apparatus 100 that allows selective use of one of the antennas 10 and 20 having different gains.

Arrangement may be made such that the antenna device 12 and the antenna device 22 have different resonant frequencies. This arrangement provides the diversity antenna apparatus 100 that allows selective use of one of the antennas 10 and 20 having different resonant frequencies.

[Second Embodiment]

Figure 2:
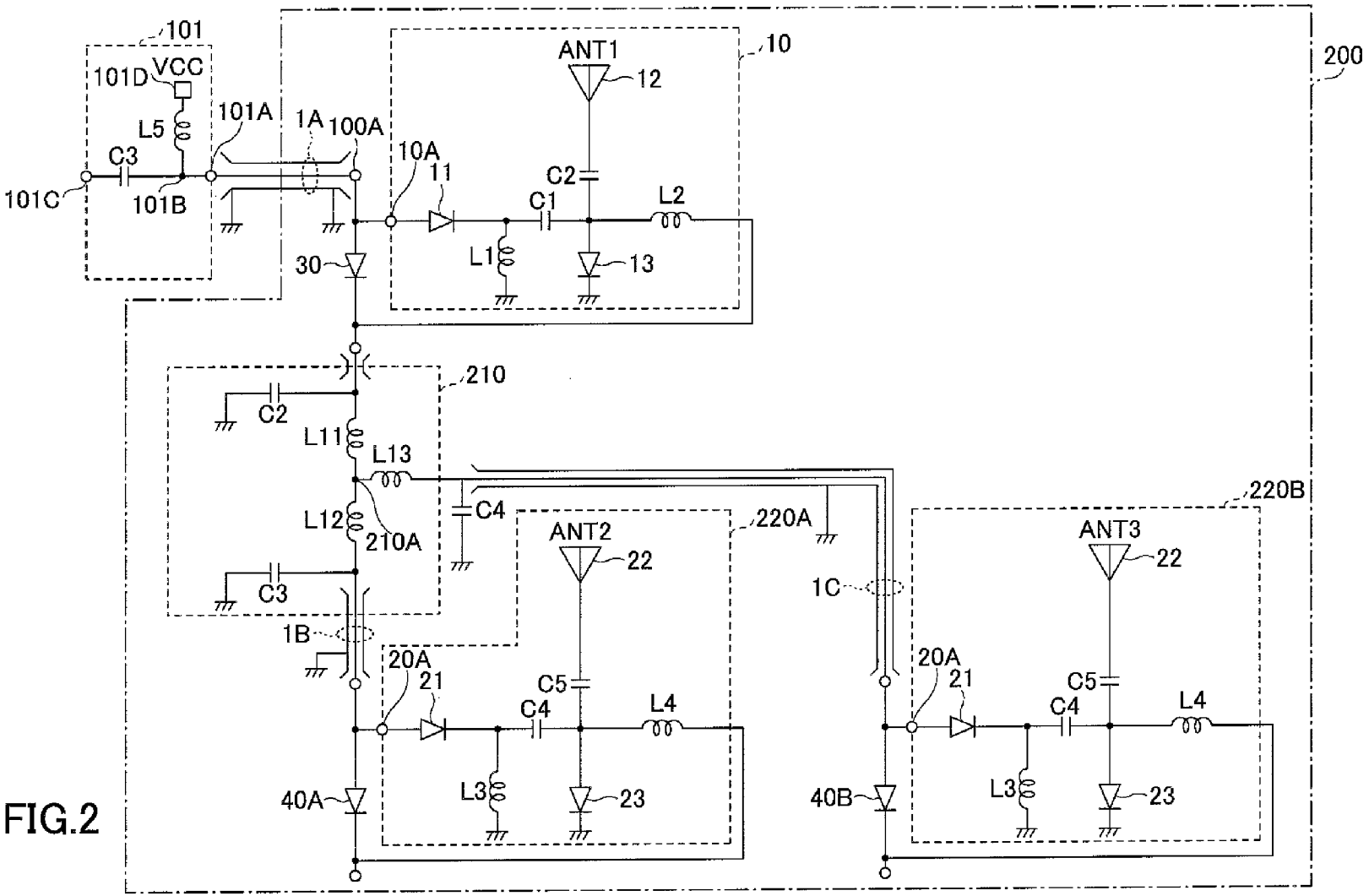
FIG. 2 is a drawing illustrating a circuit configuration of a diversity antenna apparatus according to a second embodiment.

FIG. 2 is a drawing illustrating a circuit configuration of a diversity antenna apparatus 200 according to a second embodiment.

The diversity antenna apparatus 200 of the second embodiment differs from the diversity antenna apparatus 100 of the first embodiment in that not only plural antennas are connected in cascade, but also plural antennas are connected in parallel at one of the cascaded stages.

In the following, a description will be given of the diversity antenna apparatus 200 of the second embodiment, with the main focus on differences from the diversity antenna apparatus 100 of the first embodiment. The same components of the diversity antenna apparatus 200 of the second embodiment as the components of the diversity antenna apparatus 100 of the first embodiment are referred to by the same numerals, and a description thereof will be omitted.

The diversity antenna apparatus 200 of the second embodiment differs from the diversity antenna apparatus 100 of the first embodiment in that antennas 220A and 220B and a branch circuit 210 connected to the output terminal of the rectifier device 30 are provided.

The antenna 220A has the same configuration as the antenna 20 of the diversity antenna apparatus 100 of the first embodiment.

The diversity antenna apparatus 200 of the second embodiment has a configuration in which the branch circuit 210 and the antenna 220B are newly provided in addition to the configuration of the diversity antenna apparatus 100 of the first embodiment.

Like the antenna 20 of the diversity antenna apparatus 100 of the first embodiment, the antenna 220A includes the rectifier device 21 connected to the input terminal 20A, and further includes the antenna device 22, the rectifier device 23, the condensers C4 and C5, and the coils L3 and L4, all of which are provided on the output side of the rectifier device 21. In the second embodiment, a rectifier device corresponding to the rectifier device 40 of the diversity antenna apparatus 100 of the first embodiment is referred to as a rectifier device 40A.

Like the antenna 220A, the antenna 220B includes a rectifier device 21 connected to an input terminal 20A, and further includes an antenna device 22, a rectifier device 23, condensers C4 and C5, and coils L3 and L4, all of which are provided on the output side of the rectifier device 21. The input terminal 20A of the antenna 220B is connected to the input terminal of a rectifier device 408. The rectifier device 40B corresponds to the rectifier device 40A provided for the antenna 220A.

The antenna 220B is connected to the branch circuit 210 via a feed line 1C.

The branch circuit 210 has a circuit configuration in which coils L11, L12 and L13 are connected in a star shape. The coil L11 connects between the output terminal of the rectifier device 30 and a connection point 210A that is the central node of the star-shape connection.

The coil L12 connects between the connection point 210A and the input node of the rectifier device 40A. The rectifier device 40A corresponds to the rectifier device 40 of the diversity antenna apparatus 100 of the first embodiment. The coil L13 connects between the connecting point 210A and the feed line 10.

The branch circuit 210 is provided for the purpose of providing impedance matching between the antennas 10, 220A, and 220B.

In the diversity antenna apparatus 200 of the second embodiment as described above, setting the output voltage of the variable direct-current voltage source 101D to a first voltage that is 1.0 V results in the state in which radio power is transmittable between the radio-power input terminal 101C and the antenna device 12.

Upon the output voltage of the variable direct-current voltage source 101D being set to the second voltage that is 1.8 V, the rectifier device 13 is turned on to ground the antenna device 12, so that the antenna device 12 is not available for communication.

When this happens, the rectifier device 21 in the antenna 220A is turned on, resulting in a state in which radio power is transmittable between the radio-power input terminal 101C and the antenna device 220A.

Similarly, the rectifier device 21 in the antenna 220B is turned on, resulting in a state in which radio power is transmittable between the wireless-power input terminal 101D and the antenna device 220B.

In the diversity antenna apparatus 200 of the second embodiment, thus, setting the output voltage of the variable direct-current voltage source 101D to the second voltage that is 1.8 V results in the state in which communication is performed by the two antennas 220A and 220B.

In this manner, the diversity antenna apparatus 200 of the second embodiment allows either the antenna 10 or the antennas 220A and 220B to be selected for communication in response to the control of the output voltage of the variable direct-current voltage source 101D.

Arrangement may be made such that the antenna device 12 of the antenna 10 and the antenna devices 22 of the antennas 220A and 220B have different peak frequencies at which gain becomes the maximum.

Similarly, arrangement may be made such that the antenna device 12 of the antenna 10 and the antenna devices 22 of the antennas 220A and 220B have different resonant frequencies.

[Third Embodiment]

Figure 3:
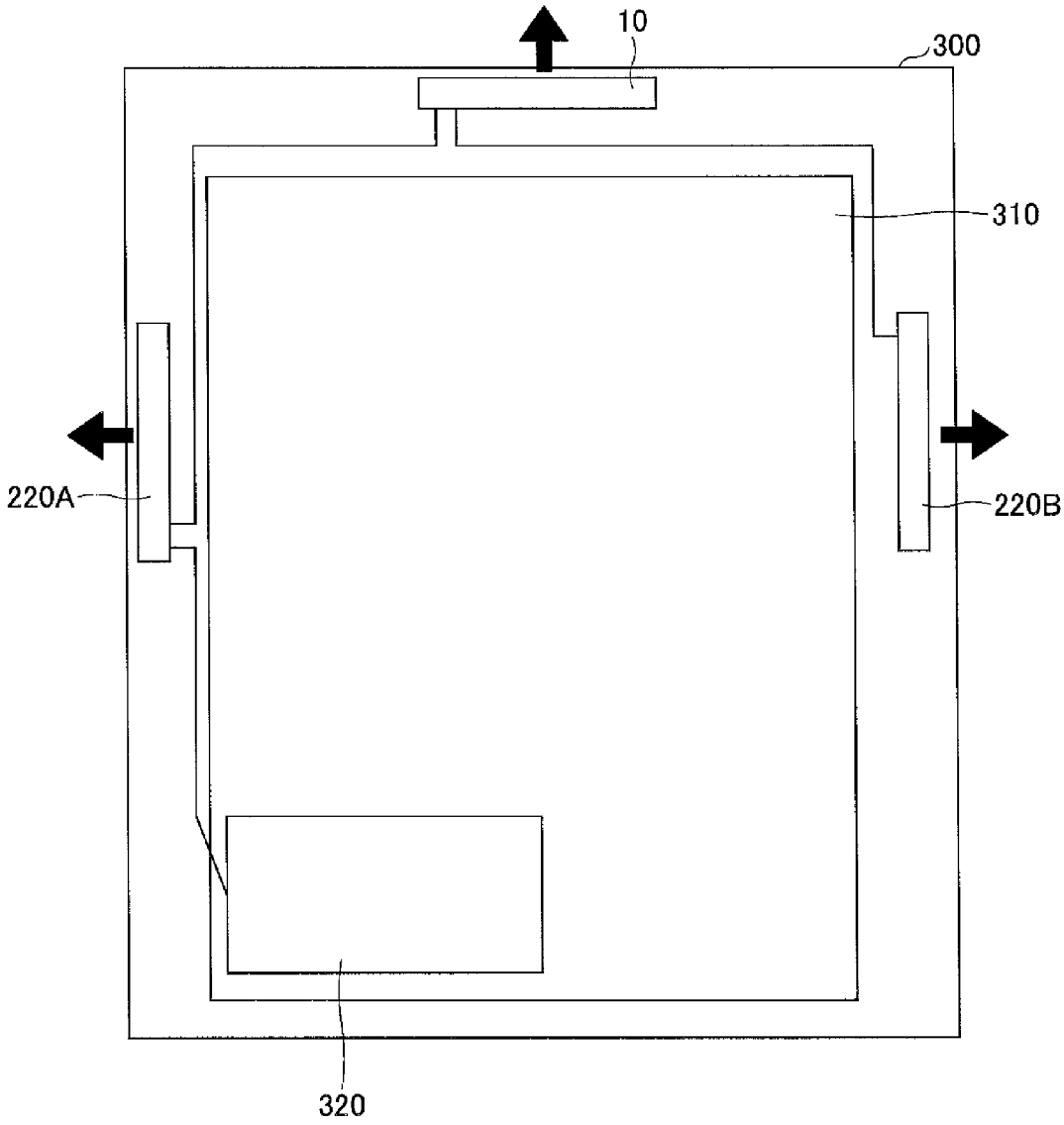
FIG. 3 is a drawing illustrating the arrangement of antennas in the wireless communication terminal device that has a diversity antenna apparatus according to a third embodiment.

FIG. 3 is a drawing illustrating the arrangement of antennas in the wireless communication terminal device that has a diversity antenna apparatus according to a third embodiment.

The third embodiment concerns the arrangement of the antennas 10, 220A and 220B of the diversity antenna apparatus 200 of the second embodiment.

The antenna 20 of the diversity antenna apparatus 200 is implemented as a wireless-LAN (Local Area Network) antenna for use in a 5-GHz frequency band. The antennas 220A and 220B are implemented as wireless-LAN antennas for use in a 2.4-GHz frequency range.

The antennas 10, 200A, and 220B are mounted on a wireless-communication terminal device 300 of the third embodiment such that the orientations of antennas in terms of directivity are arranged at 90-degree intervals as illustrated by arrows in FIG. 3.

The wireless-communication terminal device 300 may typically be a portable telephone device or a terminal device that is typically referred to as a smart phone.

The wireless-communication terminal device 300 of the third embodiment has a small-size terminal board 310, on which a wireless-LAN module unit 320 is mounted for the purpose of switching frequency bands for wireless LAN.

The wireless-LAN module unit 320 may be implemented by use of a microcomputer. The wireless-LAN module unit 320 is configured to switch output voltages of the variable direct-current voltage source 101D in order to select an antenna corresponding to a selected frequency band.

In such a wireless-communication terminal device 300, the use of the antenna 10 enables wireless-LAN communication in the 5-GHz frequency band.

The use of the antennas 220A and 2203 enables wireless-LAN communication in the 2.4-GHz frequency range, thereby providing a system that is capable of coping with both IEEE802.11a (5 GHz) and IEEE802.11 g (5.2 GHz).

As illustrated in FIG. 3, further, the antennas 10, 220A and 220B are arranged such that their orientations in terms of directivity are different from each other. With this arrangement, the stability of communication by the diversity system is further improved.

The descriptions of the diversity antenna apparatus of exemplary embodiments have been provided heretofore. The present invention is not limited to these embodiments, but various variations and modifications may be made without departing from the scope of the present invention.

The present application is based on Japanese priority application No. 2010-267446 filed on Nov. 30, 2010, with the Japanese Patent Office, the entire contents of which are hereby incorporated by reference.

What is claimed is:

1. A diversity antenna apparatus, comprising:

a feed line through which radio communication power is transmitted;

antennas connected in cascade through the feed line; and a first rectifier device placed in the feed line, wherein a first one of the antennas and a second one of the antennas each include:

a second rectifier device having an input terminal thereof connected to the feed line;

an antenna device connected to an output of the second rectifier device; and a third rectifier device having an input terminal thereof connected to a connection point between the second rectifier device and the antenna device, and having an output terminal thereof grounded, wherein the first rectifier device placed in the feed line connects between the input terminal of the second rectifier device of the first one of the antennas and the input terminal of the second rectifier device of the second one of the antennas.

2. The diversity antenna apparatus as claimed in claim 1, wherein the antenna device of the first one of the antennas and the antenna device of the second one of the antennas have different resonant frequencies.

3. The diversity antenna apparatus as claimed in claim 1, wherein the antennas include a third antenna connected in parallel to either the first one of the antennas or the second one of the antennas.

4. The diversity antenna apparatus as claimed in claim 1, wherein at least one of the antennas is oriented, in terms of directivity, in a different direction than another one of the antennas.

5. A diversity antenna apparatus, comprising:

a feed line through which radio communication power is transmitted;

antennas connected in cascade through the feed line; and one or more first rectifier devices placed in the feed line, wherein each of the antennas includes:

a second rectifier device having an input terminal thereof connected to the feed line;

an antenna device connected to an output of the second rectifier device; and a third rectifier device having an input terminal thereof connected to a connection point between the second rectifier device and the antenna device, and having an output terminal thereof grounded, wherein one of the one or more first rectifier devices placed in the feed line connects between the input terminal of the second rectifier device of a given one of the antennas and the input terminal of the second rectifier device of another one of the antennas that is situated immediately downstream on the feed line relative to the given one of the antennas.

* * * * *